United States Patent [19]

Brouwer et al.

[11] 4,384,596

[45] May 24, 1983

[54] MEANS AND METHOD FOR SENSING LOOM CONDITIONS INDICATIVE OF POTENTIAL FABRIC DEFECTS

[75] Inventors: Charles W. Brouwer, East Greenwich, R.I.; Edward L. Maddox, Lexington, Mass.

[73] Assignee: Leesona Corporation, Warwick, R.I.

[21] Appl. No.: 223,226

[22] Filed: Jan. 7, 1981

[51] Int. Cl.[3] ..... D03D 51/34; G01N 21/89

[52] U.S. Cl. ..... 139/370.2; 250/227; 250/561; 250/571

[58] Field of Search ..... 139/370.2, 370.1, 336, 139/371, 1 R; 250/559, 561, 571, 227; 66/157, 163; 57/81; 28/187; 356/237; 340/677, 675

[56] References Cited

U.S. PATENT DOCUMENTS

| | | | |
|---|---|---|---|
| 3,410,316 | 11/1968 | Guittari . | |
| 3,613,743 | 10/1971 | Sakamoto . | |
| 4,027,982 | 6/1977 | Ohishi | 250/227 X |
| 4,085,777 | 4/1978 | Dadak et al. . | |
| 4,146,061 | 3/1979 | Goton . | |
| 4,147,977 | 4/1979 | Dimmick | 250/227 X |
| 4,150,699 | 4/1979 | Suekane | 139/370.2 |
| 4,178,969 | 12/1979 | Goton et al. . | |
| 4,188,901 | 2/1980 | Suekane . | |
| 4,188,981 | 2/1980 | Suekane et al. | 139/370.2 |
| 4,270,579 | 6/1981 | Nakanishi | 139/370.2 |

FOREIGN PATENT DOCUMENTS 1236346 6/1971 United Kingdom .

*Primary Examiner*—James Kee Chi

*Attorney, Agent, or Firm*—Burnett W. Norton

[57] ABSTRACT

A first sensor comprising interspersed light emitting and receiving fibers is situated at the egress slot of an air containment element on a fluid weft insertion type loom and retroreflectively senses filling yarn as it egresses from the element. The first sensor, placed along the length of the air containment tube, together with a second sensor outboard of the shed is used to discriminate filling yarn condition and the impact of those conditions on fabric quality. Signals from the first and second sensors are employed in a logical method to permit continued operation of the loom when particular faults are sensed but do not represent conditions warranting stopping of the loom, while said sensors do produce loom stopping signals when faults of predetermined values are sensed. Loom output efficiency is thus improved by allowing a controlled number of defects to enter the finished fabric.

12 Claims, 9 Drawing Figures

MEANS AND METHOD FOR SENSING LOOM CONDITIONS INDICATIVE OF POTENTIAL FABRIC DEFECTS

BACKGROUND OF THE INVENTION

This invention relates to the operation of a loom and relates more particularly to the method and means for monitoring and controlling the quality of fabric produced on a loom.

In order that fabric of acceptable quality may be made there are certain conditions in the weaving equipment that need be controlled. For example, defective feed of weft or warp yarns, broken yarns, or missing or improper filling yarns (picks) may result in defects in the fabric. It has been conventional in the art to have sensors and control mechanisms on the looms to stop the looms for manual correction of some defects. However, stopping the loom for fabric repair does not assure that the fabric ultimately woven will be of perfect quality. For example, since an improper pick is removed and replaced under operator control and since it is necessary to manipulate the fabric advancing mechanisms to insert a replacement pick, considerable opportunity for improper repair exists. Hence, it has been customary to inspect the fabric after it has been woven and removed from the loom and, if too many defects appear in the fabric, then it is graded to a lower quality.

It is an objective of the present invention to predict the fabric quality as it is woven and to operate the looms in a fashion such that fabric quality can be automatically and continuously predicted. Therefore, a problem resolved by this invention is the prediction of the quantity of potential fabric defects as the fabric is being woven with concomitant provision within the loom of means for processing predicted quality so that most fabric need not be further inspected.

Furthermore, the output efficiency of looms is significantly deteriorated by the requirement that the looms be stopped for correction and restarting under all conditions. Thus, in a mill with perhaps forty looms under surveillance of a single operator, several looms may be taken off line simultaneously while the fabric on only one can be repaired at a time. Accordingly, it is a further objective of this invention that defects be sensed and processed in such a way that the output quantity of the loom is increased and that stopping for repair can be avoided whenever looms are running at a low error rate.

To achieve these general objectives it is necessary to detect appropriate sources of potential fabric defects in the looms and set into motion corresponding control operations. Although it has been customary in the art to detect, for example, certain types of defects for the purpose of stopping the loom, these in general have been limited to detecting broken filling, broken warp, or missing filling. The system of U.S. Pat. No. 3,410,316 issued to J. Giuttari on Nov. 12, 1968 senses the presence of a weft yarn mechanically in a shuttleless loom by means of a movable feeler arm. Many other filling or yarn processing sensors are mechanical in nature and are not generally feasible for use in modern high speed shuttleless looms. Accordingly, electronic weft or filling sensors have been developed which operate to determine in the course of each pick period the presence of a pick.

Within the environment of air jet looms it has been convenient to sense the condition (presence or absence) of each filling yarn as it egresses from the air containment tube. Typically the following patents provide photo-electric sensors that may be located in the confusor element exit slot to determine the passing of a filling yarn out of the confusor: U.S. Pat. No. 4,085,777 issued to Z. Dadak et al. on Apr. 24, 1978; U.S. Pat. No. 4,150,699 issued to J. Suekane on Apr. 24, 1979; U.S. Pat. No. 4,188,901 issued to J. Suekane on Feb. 19, 1980; and British Pat. No. 1,236,346 of E. Sick published June 23, 1971.

Although these prior art sensors may be applicable for their intended purpose, there are certain types of critical yarn defect conditions in the weaving process that may not be discriminated without improvement in the sensing and control mechanisms.

Beyond the foregoing there are prior art systems for weaving machines to identify output quality and to decrease machine down time for mechanical repairs as, for example, set forth in the following documents:

U.S. Pat. No. 3,613,743 issued to T. Sakamota on Oct. 19, 1971 which applies an automatic fabric inspection apparatus to a loom to inspect and record the quality of fabric produced. This patent relates strictly a post-fabric formation inspection device.

U.S. Pat. No. 4,178,969 issued to M. Gotoh et al. on Dec. 18, 1979 which provides a system mode of operation which keeps weaving machines with lower machine repairs in operation awaiting off-line maintenance until higher priority repairs are corrected.

U.S. Pat. No. 4,146,061 issued to M. Gotoh on Mar. 27, 1979 where index yarn or yarns are inserted to mark fabric for identifying an event such as an improperly inserted pick as an aid in inspection and postprocessing of the fabric.

None of the foregoing nor other known prior art predicts the quality of the fabric at the point of fabric formation. Neither does the prior art provide for operation of a loom in a greater output mode in response to a favorable high quality operating condition. These objectives are achieved by the present invention.

SUMMARY OF THE INVENTION

In accordance with the present invention, novel sensors and indicators are provided together with control systems and methods for prediction and control of fabric output quality from a loom. With the improved sensors, looms may be operated in response to predicted quality indicia or statistically calculated indices derived from a multiple of signals sensed in the various portions of the loom. Additionally, an increased output mode producing more fabric from a loom than heretofore feasible can be employed while maintaining acceptable output quality.

More specifically, selvage edge defects not heretofore sensed in loom control systems are discriminated by means of improved filling or weft yarn detection means for sensing at critical positions of the filling passing through the confusor tube. Such defects as a blown pick, short pick, or selvage defects such as a jerk-in or folded over selvage end filling yarn may be electronically detected at high speeds with considerable accuracy and used for loom control as well as prediction of fabric quality. Also, certain other loom conditions can lead to probable fabric quality changes and thus are desirably processed to derive a fabric quality index.

In accordance with the present invention novel sensing means are provided in a confusor element. A retroreflective photoelectrically induced signal is processed by a randomly oriented bundle of optical fibers to produce a reinforced signal distinguishable from noise. This retroreflective technique provides a more advantageous signal than heretofore available because a signal of longer duration is generated. Other more conventional signals indicating defective warp or filling yarn conditions are also employed to determine a fabric quality control index from a variety of loom conditions that might cause a defect in the fabric output. The detected signals are displayed, counted or statistically analyzed to produce a quality control index. Typically the index predicts potential defects in the fabric per unit length measure. A quality control index prediction of fabric quality is thus calculated as the fabric is formed on the loom, without examination of the produced fabric. The index, in addition to precluding the need for manual post-inspection of the fabric, is also used as a control trigger for bypassing loom stopping when the index is favorable.

Thus, with looms having a quality control index available scheduled priorities of shutdown may be determined to keep looms in a mill running with more output efficiency. With the provided information an operator may run more looms in a mill with higher running time efficiencies as a result of this invention. For example, loom output efficiency is attained by manual or automatic control to eliminate machine shutdowns for minor defects which can be tolerated in the output fabric whenever the quality control index is above predetermined acceptable quality threshholds.

Other features, advantages and objectives of the invention will be found throughout the following drawings, claims and more detailed description.

DESCRIPTION OF PREFERRED EMBODIMENT

Figure 1:
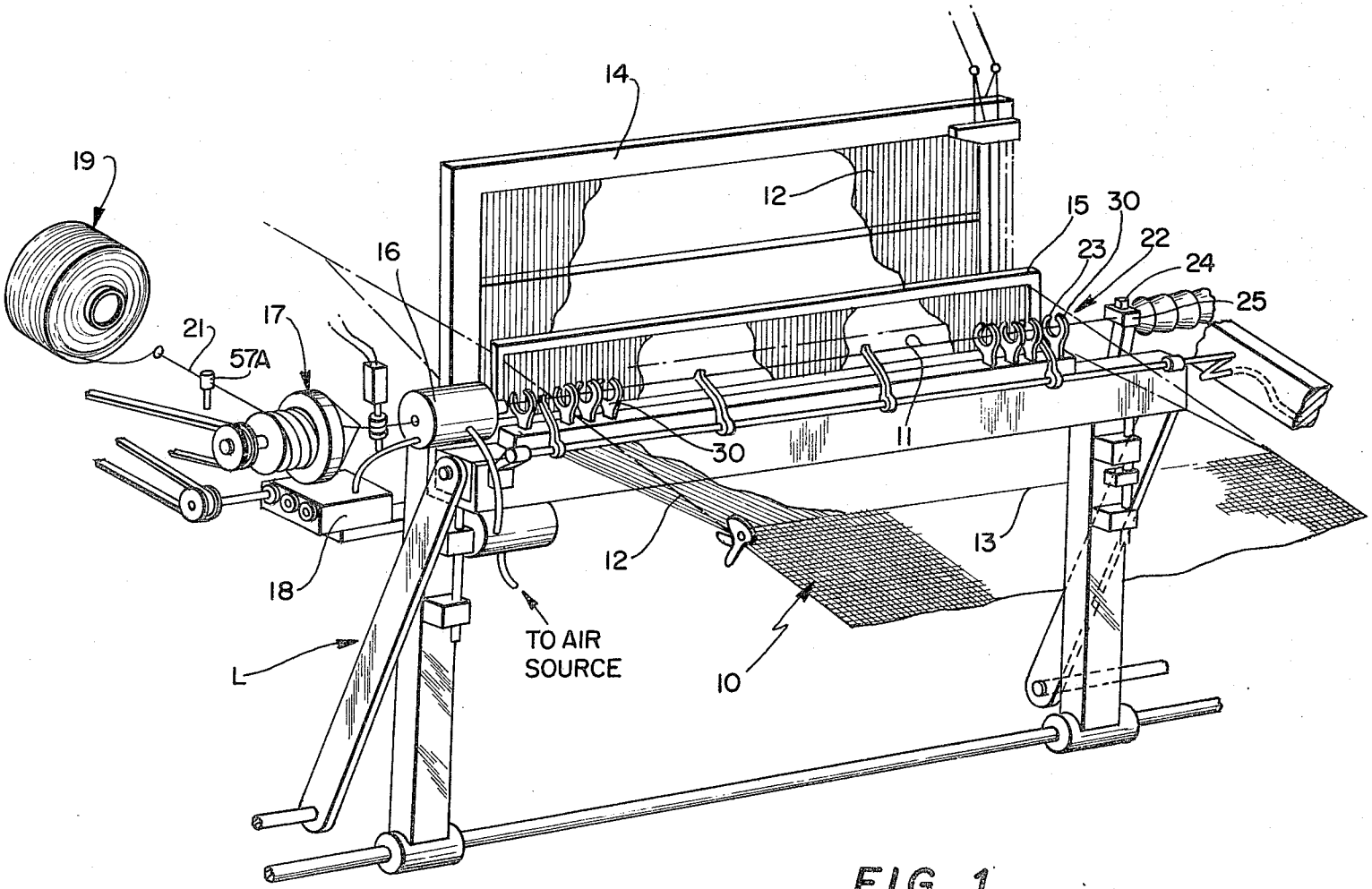
FIG. 1 is a perspective view of pertinent loom features illustrating the operational features of the present invention.

With reference initially to FIG. 1 there is illustrated a loom L for producing fabric 10 by inserting filling yarn lengths 11 or, simply "filling", into the shed where warp yarns 12 are manipulated by the warp framework or harnesses 14, 15. Thus, each filling 11 is inserted under proper tension and forced against the preceding such filling yarn length in place at the boundary or fell 13 of the woven fabric 10. The loom L illustrated is a shuttleless loom of the type more particularly shown and described in detail in commonly assigned U.S. patent application Ser. No. 064,180 of C. W. Brouwer, et al filed Aug. 6, 1979, now U.S. Pat. No. 4,347,872 and which is incorporated herein by reference. In this loom an air source is pulsed through a gun 16 at a time controlled by appropriate signals from a timing means 18. Yarn 21, which is the source of each pick 11, is supplied from package 19 through filling yarn feed mechanism 17. A warp yarn feed mechanism (not shown) supplies a continuous feed of warp yarns 12 at a speed consistent with the production of fabric 10. As each filling 11 is inserted in a timed relationship by gun 16 the filling is propelled through a confusor tube 22 comprising a set of confusor elements 30. Each filling 11 is then received and held at the selvage end in a vacuum receptor 24, assuming the pick is a normal pick moving in a normal path.

The propensity for error in a weaving operation as just described is significant in the filling operation. For example, a filling 11 may not reach the receptor 24, or the filling may be broken, folded, or otherwise unsatisfactory. Also, other types of faults may occur which will disturb the quality of the output fabric 10. As previously stated, looms are conventionally provided with sensors which stop the looms for repairs when the weft or filling yarn is broken or when the pick is missing. Even though the repairs are made the stopping and starting of the loom disturbs its rhythm and may cause the next inserted filling to be visibly different from the rest of the woven fabric 10. Such defects result from improper weft repair and loom starting techniques employed by operators of varied skill. Thus, each loom stop may affect the quality of the fabric.

Fabric is normally rated as first or second quality on the basis of inspection of the fabric to determine how many faults per unit length are present. These faults may be weighted in establishing a quality control index such as, for example, allocating ten points for a major fault and one or two points for a minor fault. Statistically, specific reasons for loom stoppages and subsequent fabric repair yield widely divergent quantities of major faults. For instance, repairs of broken or missing fillings are far more frequently incorrectly repaired in comparison to repair of broken warp ends. In large measure this is due to the necessity of matching the proper shed sequence and pitch of filling yarns. Consequently, a higher percentage of filling faults yield major fabric defects than do warp repairs.

The present invention directly analyzes the loom performance to provide its running quality control index by sensing various loom or yarn feed conditions and counting them. The sensed conditions may be statistically analyzed to predict or indicate a running rate of fault occurrences per unit length of fabric in a probable quality control index. Such index provides a criterion for either a monitor of fabric grade to identify first or second grade fabric, or a control of the loom in order to achieve acceptable output quality with higher production efficiency.

Figure 2A:
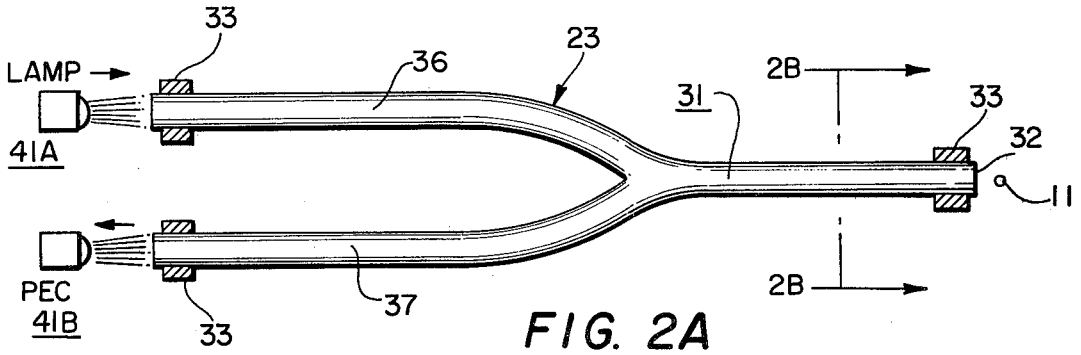
FIGS. 2A, 2B and 2C are respectively side, end and gap views of an improved photoelectric sensing means afforded by this invention.
Figure 2B:
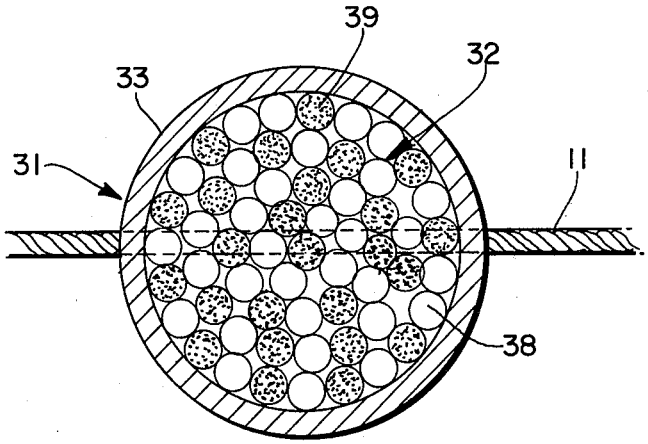
Figure 2C:
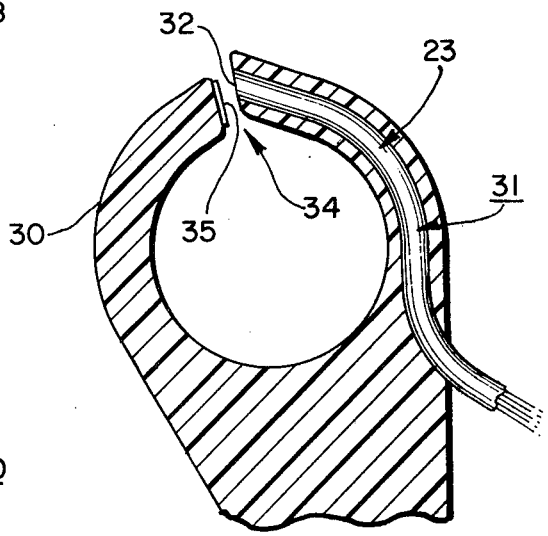
Figure 3:
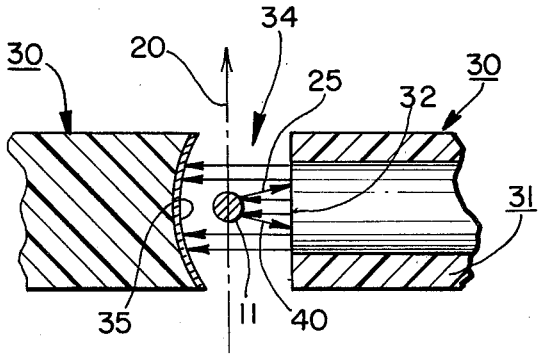
FIG. 3 is a diagrammatic segmental view of the sensing means illustrating detection of light reflection from a yarn passing the sensor head.

This analysis requires improvements in sensing loom conditions, particularly filling yarn conditions. In the present invention these improvements include sensors 23 and 24. Sensor 23 consists of an optical fiber bundle 31 integrated within a confusor element 30 for the purpose of detecting filling yarn as it egresses the confusor tube. Traditionally, in the art of weft insertion, confusor element sensors have heretofore provided signals which are of extremely short duration due to the fact that filling yarn egresses from the confusor tube at a very high speed and prior art sensor geometry has been limited to very small sensor sizes. In the present invention improvements in the signal system are achieved by constructing the improved sensor 23 as shown in FIGS. 2A–2C. Thus, sensor 23 includes the optical fiber bundle 31 which has a viewing face 32 bound by a steel band 33. Fiber bundle 31 joins at a suitable remote location with a lamp 41A and a photoelectric cell 41B as seen in FIG. 2A. The fiber optical bundle actually consists of two sets of fibers, identified as fiber sets 36 and 37, respectively, in FIG. 2A. Fiber set 36 constitutes a light transmitting set while fiber set 37 is a signal receiving set. As best seen in FIG. 2A fiber sets 36 and 37 are joined part way along their lengths to form the common fiber bundle 31 which terminates in the sensor face 32. Viewing sensor face 32 in FIG. 2B it will be seen that fiber sets 36 and 37, actually consist of a plurality of individual optical fibers 38 and 39, respectively. The plurality of fibers 38 and 39 are interspersed with each other in random fashion, that is to say, the fibers 38 and 39 are uniformly distributed throughout the sensor face 32, to thereby maximize the time of retroreflection of light from the filling 11 as the filling transverses the entire sensor face 32. Thus, fiber set 36 transmits a light signal modulated by reflection 25 (FIG. 3) off the filling 11 and carried back by the fiber set 37 to the photocell 41B. As best seen from FIG. 3, the gap 34 between opposing faces of the confusor element 30 permits filling 11 to pass transversely and depart along gap pathway 20. While filling 11 is in the field of view of the fiber optic bundle 31 light rays 40 are transmitted from fibers 38 in set 36, and are received primarily within the face 35 of the confusor element 30, which desirably is recessed and provided with a non-reflective surface, preferably black, to increase the signal to noise ratio. Thus, a significant part of the light rays 25 reflected back into the fiber set 37 for detection are those reflected off the filling 11 passing through the gap 34. The individual fibers are preferably of a diameter approximating that of the filling 11. Thus, as the filling 11 transverses the sensor face 32, pickup sensor fibers 39 transport light reflected from the yarn to the photo-electric cell 41 by means of the fiber set 37 containing the randomly interspersed fibers 39 which collect light as the filling progresses across the sensor face 32 producing a maximized signal change and duration. Because of the multiplicity of randomly placed fibers, therefore, the signal received will be sustained with a definite expected increase of received light level over the time it takes for the filling 11 to travel across the entire sensing face 32. In this manner flutter of the fiber is eliminated as a significant factor in shape or duration of the signal. Typical dimensions in the sensor include a fiber diameter in the order of 0.001 inch (0.25 mm) and a diameter of the sensing face 32 in the order of 0.040 inch (10 mm). Sensor 23 is most conveniently used when fiber bundle 31 need only meet the confusor gap 34 on one face 32.

Distinct advantages of this detector 23 is its insensitivity to any mispositioning or flutter of the yarn, and production of a signal of definite characteristics and duration distinguishable from random noise impulses. Clearly, therefore, the improved sensor 23 provides a more definite and improved signal. Sensor 23 may be positioned in any of several locations, or a plurality of sensors 23 may be disposed at a variety of locations along the length of confusor tube 22. It has been found advantageous to place one sensor 23 near to but slightly inboard on the right hand end of the fabric being woven (viewing FIG. 1) say, inboard of the right hand selvage of the fabric about 2 inches. Sensor 23 and its placement permits analysis of the status of a pick at the selvage end of the filling.

Turning now to consideration of sensor 24, as best seen in FIG. 1 this sensor is located with vacuum receptor 25. This sensor 24 and its mode of operation are more particularly set forth in the aforementioned U.S. patent specification Ser. No. 064,180 of Charles W. Brouwer, et al. Briefly, sensor 24 consists of an array of three light emitting diodes opposed by three photodetectors and serves to detect filling 11 as the filling enters vacuum receptor 25 when light is interrupted by the reception of filling 11 therein.

The combination of sensors 23 and 24 are employed advantageously in the present invention in detecting filling failure modes heretofore undetectable. These sensors also serve the objective of improving loom output and yarn quality as will be hereafter more specifically described.

Normally, in routine operation of loom such as that shown in FIG. 1, filling 11 is conveyed through the shed and deposited in vacuum receptor 25. Sensor 24 detects that latter event. However, conditions occur where filling 11 is not properly inserted and does not reach vacuum receptor 25 and, thus sensor 24. This can result when the pick is wrinkled, folded, short, missing, or blown off. If these insertion errors were allowed to pass into the completed fabric the location of these defects would have tremendous variation in impact on fabric quality. For example, a pick inserted to within two inches of the right hand selvage is classified as a minor fabric fault. This region is identified as a selvage border region. However, a pick inserted short by three inches or more is classified as a major fabric fault. Typically, for a fabric grading system allowing up to 40 quality points per 100 yards of fabric for first quality fabric, a minor fault is assigned 1 point and a major fault 10 points. The locations of folds or wrinkles along the inserted pick have similar impact on quality ratings.

Two additional improper insertions require further explanation. False stops are picks properly inserted within the fabric body but which did not get sucked into the vacuum receptor 25. In the mode where a single sensor 24 is employed, the sensor 24 indicates a filling fault shutting down the loom despite the fabric being without fault. This error would have no impact on fabric quality. When such faults are detected in the manner hereinafter shown improved loom output efficiency may occur by avoiding shutdown for false stops.

Another improper insertion is unique to air jet looms and designated as a blown off pick. In this instance, a variety of different machine or yarn conditions may result in the pick being severed during the process of insertion and carried in its entirety into the receptor sensor 25. Despite the positive signal from the receptor sensor 25 that the pick is in place, the fact is that the pick is not present in its proper position in the shed. Consequently, a major fabric fault results.

The critical placement of fiber optic sensor 23 in combination with sensor 24 enables analysis of these potential errors and their location. Thus, these detectors discriminate between errors of minor and major fabric quality impact. The following table tabulates insertion error conditions, sensor 23 and 24 signals responsive to these insertion conditions and the impact of these errors on quality.

| Detectable Insertion Errors | Sensor 23 | Sensor 24 | Quality Impact |
|---|---|---|---|
| False Stop | Yarn | No Yarn | None - (But impacts on output) |
| Wrinkled, Folded, or Short Reaching Sensor 23 | Yarn | No Yarn | Minor |
| Wrinkled, Folded, Missing, Short Not Reaching Sensor 23 | No Yarn | No Yarn | Major |
| Blown Off Pick | No Yarn | Yarn | Major |

From the foregoing table it is seen that not only can the present invention sense loom conditions heretofore unachievable but also it is seen that fabric quality impact between major and minor defects can readily be discriminated and output loom efficiency can be improved. Sensor 23 always sees no yarn for an error of major magnitude.

Figure 4:
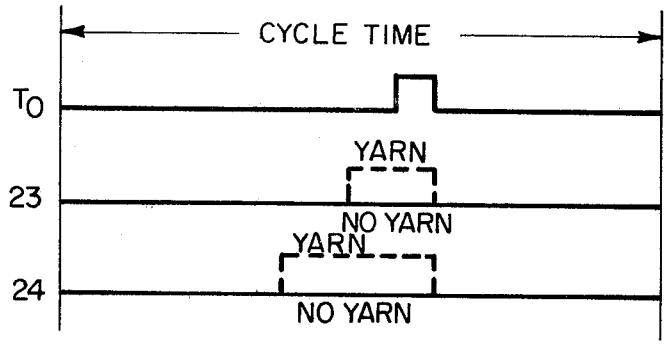
FIG. 4 is a timing waveform chart.
Figure 5:
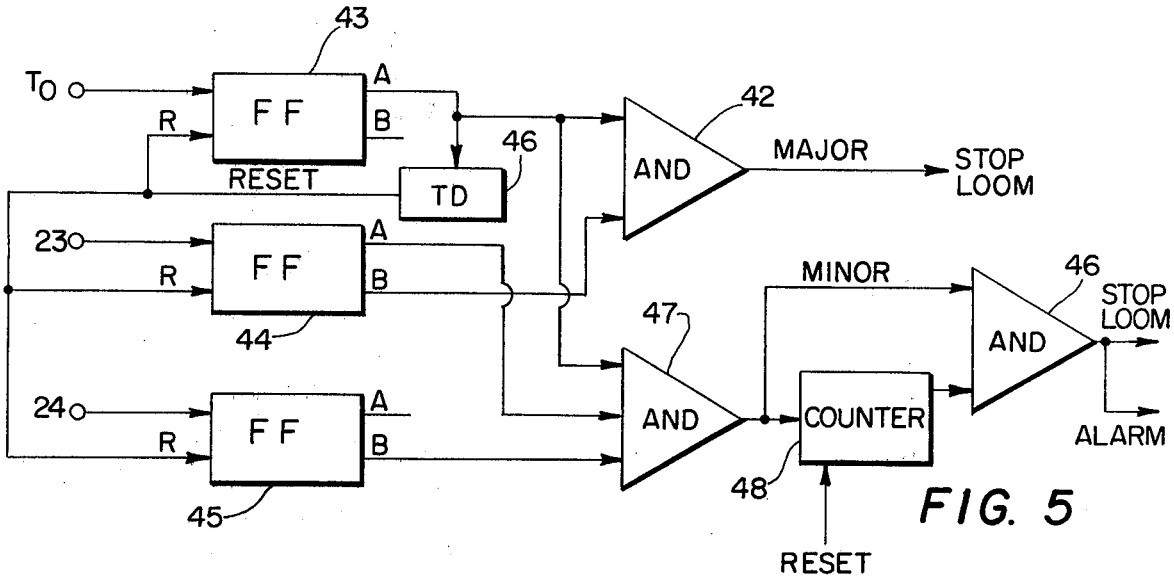
FIG. 5 is a schematic block circuit diagram of a sensing circuit arrangement embodying the invention.

In FIG. 4 $T_O$ is a reference signal that is timed by the loom crankshaft rotation at a point in the cycle indicating timing synchronism with the time when the yarn pick should have inserted and has been removed from confusor tube 22. The relative timing of the signals at sensors 23, 24 is shown in FIG. 4. These signals are processed in the circuit of FIG. 5 in a mode of operation afforded by this invention.

As seen in FIG. 4 flip flops 43, 44, 45 respectively, receive and latch signal $T_O$ and the signals from sensor 23 and sensor 24. Each flip flop has two output positions, A and B, where A is normally low and B normally high. On receipt of an input signal, outputs A and B reverse so A is high and B is low. Since a major fault has occurred when sensor 23 does not see yarn, (i.e., pick 11 has not reached sensor 23 the output B of flip flop 44 remains high and is fed to AND gate 42. Also output A of flip flop 43 is fed to AND gate 42 so that both inputs to AND gate 42 are satisfied and produces an output signal to stop the loom. Since a minor fault potentially has occurred when sensor 23 sees yarn but sensor 24 does not see yarn (i.e., the pick does not reach vacuum receptor 25) output A of flop flop 44, output B of flip flop 45 and output A of flip flop 43 are fed to AND gate 47 so that all three inputs of AND gate 47 are high and a signal is outputted from AND gate 47. This output signal is fed to AND gate 46 as well as to counter 48. Counter 48 can be set to produce a continuous output after an adjustable preset count has been achieved. The counter output is also fed to AND gate 46. Therefore, for any minor fault signal emitting from AND gate 47 after the counter preset value has been reached will satisfy both inputs to AND gate 46 so that a signal is outputted from AND gate 46 to stop the loom and set an alarm to indicate excessive minor faults. Until the preset count of counter 48 has been achieved, minor faults do not act to shut down the loom. Flip flops 43, 44, 45 are reset by feeding the output A of flip flop 43 through time delay 46 which, in turn, outputs a signal upon completion of time delay to all resets R. This delay, which is controlled by time delay 46, is determined to permit completion of all control functions prior to resetting. Counter 48 may be periodically or otherwise reset.

The foregoing description is a representative means for effecting control of loom L whereby output efficiency of the loom is increased by precluding loom stops while maintaining acceptable fabric quality output. However, this invention advantageously provides for predicting fabric quality with or without intervention into the loom to control its operation. The circuit of FIG. 6 represents a simplified quality control prediction embodiment of the invention.

As previously stated, although the loom L is or can be stopped for any type of fault, the manual repairs may not result in perfect fabric. Common failures on fabric repair are defects, normally called "set marks" where the filling pitch, thread to thread, displays a variation either too close or too far apart. Statistically, all filling repairs necessitate the removal of a poorly inserted pick and the attendant adjustment to the fabric advancing mechanism. This procedure results in a significantly higher percentage of major faults than does the repair of warp. This invention monitors various stops and sensor data, predicts on the basis of statistical impact, and decides on the basis of probable quality whether to effect stopping of the loom for manual repair or to pass the defect into the fabric while still maintaining acceptable fabric quality. The invention also eliminates the need for complete manual inspection of the fabric by identifying and displaying probable quality so that at the time of finished fabric doffing the quality level can be recorded on the doffed fabric.

Figure 6:
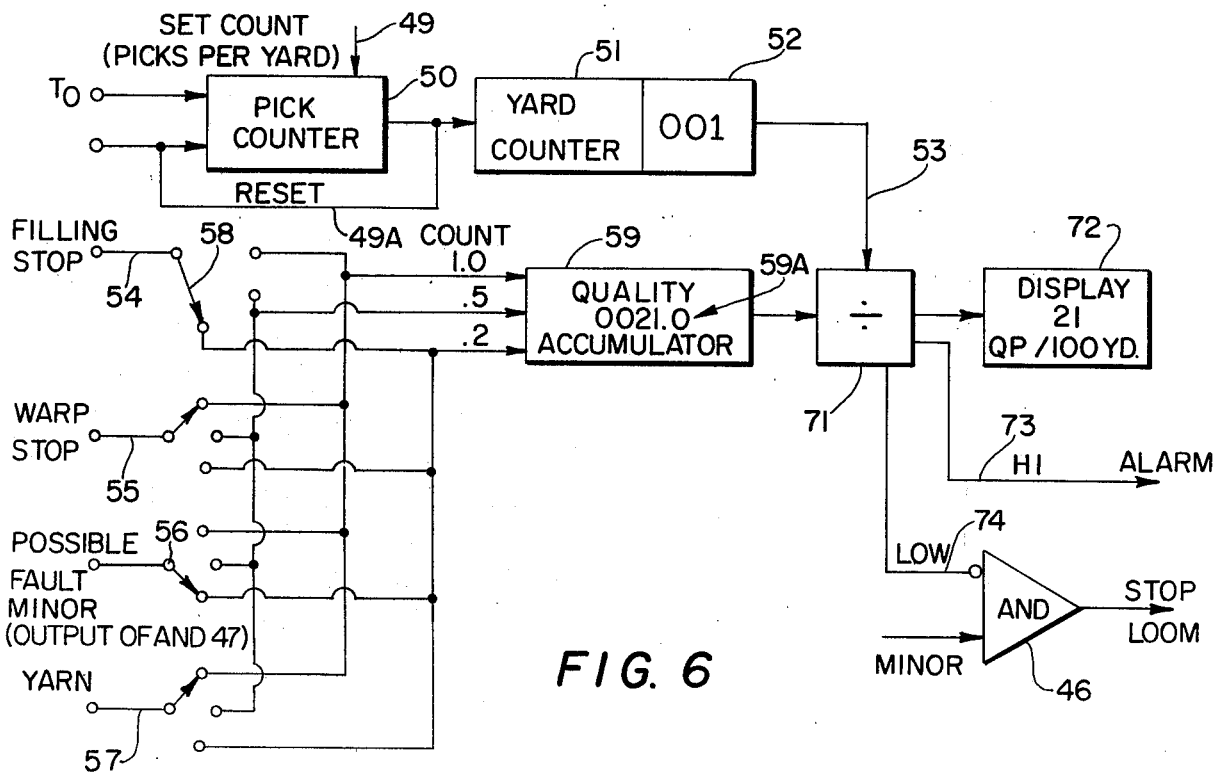
FIG. 6 is a block circuit diagram of a quality control system embodying the invention.

Referring to FIG. 6, pick counter 50 operates to produce an output signal when one yarn of fabric has been woven on loom L. An adjustable set count 49 is set into pick counter 50 which equals the number of picks per yard of fabric woven. Upon achieving the preset count counter 50 outputs a signal to yardage counter 51 and a simultaneous signal through line 49A to reset pick counter 50 to zero. Yardage counter 51 accumulates and displays via panel 52 the total number of yards of fabric woven since inception of the current weaving cycle.

To determine the probable or predicted fabric quality, stop signals of both the filling and warp type are detected for processing at input leads 54 and 55, respectively. Any conventional stop signal mechanism can be employed to produce such signals. As described herein, a filling stop signal is derived via AND gate 42 and fed to lead 54. The signal to input lead 55 may be produced by the operation of a conventional warp drop wire detector (not shown). Further, minor faults as indicated by a signal output from AND gate 47 may be detected at lead 56. Additionally, other loom system conditions that might affect fabric quality may be sensed at lead 57. These might include yarn slubs, for example. Such a slub condition could be detected by a conventional electronic slub detector 57A (FIG. 1.) connected into lead 57.

The weight of each condition in determining a quality index is assigned by means such as switches 58 in this embodiment, which select inputs to a counter-accumulator 59 for typically registering one, one-half and two-tenths output points. The weight can be varied to justify a count to any appropriate quality control index standard, and, if desired, supplemental counters or dividers may be used. Thus, the register display 59A will show accumulated quality points for all detected conditions. This information by itself is valuable in showing whether the quality is good or bad, so that in accordance with this invention goods may be marked, corrective action taken or production quantity improved.

For a running index rate conventionally used as a quality measure, namely weighted faults or quality points per unit fabric length such as 100 yards, the accumulated points on counter 59 are divided by the number of hundreds of yards produced via lead 53 to division circuit 71 from which the quality point (QP) index points per 100 yards is derived and displayed on panel 72. A typical weighting for accumulating points in a system is developed on the following table summarizing operation at the end of a first 100 yards of fabric processed.

| INPUT | COUNT | WEIGHT | PROBABLE QP | QP/100 YD. |
|---|---|---|---|---|
| Filling stops | 12 | 1 | 12.0 | |
| Warp stops | 10 | .2 | 2.0 | |
| Minors | 6 | .5 | 3.0 | |
| Filling yarn | 4 | 1 | 4.0 | |
| | | | 21.0 | 21.0 |

Thus, display 72 will show 21.0 per hundred yards.

Assuming that an acceptable quality point index were 40, then any count on display 72 greater than 40 could generate an alarm at lead 73. Conversely, a low count such as 20 or below could provide on lead 74 a signal which would inhibit a minor fault stop of the loom at AND gate 46, since the likelihood of obtaining second grade quality fabric would be slight. Under these circumstances the circuit diagram in FIG. 5 would be altered so that counter 48 would be replaced by input lead 74. Thus, the feature provides more efficient output from the loom whenever quality conditions are high. Other magnitudes could be used for making these control decisions.

This invention therefore senses the loom operation, not the produced fabric, and may therefore predict the quality of the fabric being produced and provide a running index of fabric quality as it is being produced.

Figure 7:
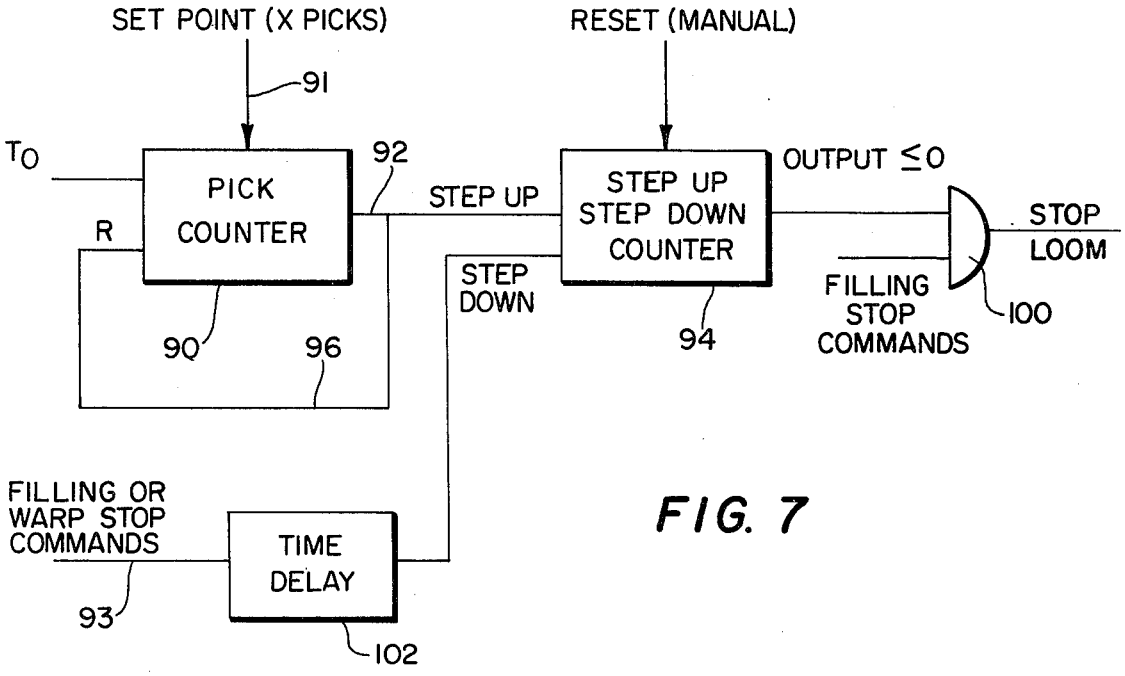
FIG. 7 is a block circuit diagram of a simplified embodiment illustrating principles of operation of this invention to monitor stop performance of the loom in relation to yards of fabric produced and allowing the filling defects to pass into fabric under preset conditions.

An alternative concept for increasing loom productivity is shown in FIG. 7. This simplified, less expensive approach does not require presence of sensor 23 foregoing the necessity of qualifying whether the potential fabric defect is of major or minor impact.

Referring to FIG. 7, counter 90 counts the number of $T_O$ signals and, hence, the number of filling picks inserted. Further counter 90 can be preset to an adjustable value at 91 and when this value is achieved will output a signal at lead 92. This output signal is routed to the step up input of a step up/step down counter 94. The output 92 of counter 90 is also fed via lead 96 to a reset R on counter 90. Hence, counter 90 produces a momentary output each time it reaches its preset value. A typical value for counter 90 is the picks produced in one hour of operation at 100% efficiency. Such setting in counter 90 is a convenient reference for either elapsed weaving time or, in the alternative, length of fabric woven. Filling or warp stop commands 93 are fed to the step down input of step up/step down counter 94. Step up/step down counter 94 is arranged so that it will output a continuous signal whenever the counter value is zero or less than zero. Thus, this counter 94 is performing the function of monitoring loom performance. When using a set point value of one hour of picks produced on the loom on counter 90 and when counter 94 has a value above zero, the loom is operating at less than one stop per hour. If counter 94 is zero or less, the loom is operating at a stop rate in excess of one stop per hour. Both the outputs from counter 94 and the filling stop command are fed to AND gate 100. Hence, when the loom is running at an acceptable level, counter 94 has no output and the filling stop command, derived from sensor 24, is inhibited from stopping the loom. If the loom is running at an unacceptable level, and consequently likely to produce excessive fabric defects, there is an output from counter 94 which allows stop commands derived from sensor 24 to stop the loom. Since warp stop commands will continue to occur until the warp break is repaired, only the filling stop commands are qualified at AND gate 100. A time delay 102 is inserted in the path of stop commands and is in the order of one loom cycle to allow proper operation of AND gate 102 before stepping down counter 94. Obviously, the preset values of set point 91 and step up/step down counter 94 can be adjusted as desired.

From the foregoing it will be seen that the present invention advantageously provides means and method for sensing loom conditions during the weaving cycle, analyzing the sensed conditions and controlling loom operation in response thereto so as to allow a controlled number of defects to be woven into the finished fabric but to stop the loom when the defects or faults exceed a predetermined value. The invention further provided improved sensing means for weft yarn leaving an air containment tube, such sensing means providing a device for providing a signal indicative of certain of the faults which may occur during the weaving cycle. By virtue of the features offered by the present invention loom output efficiency is improved by allowing a controlled number of faults to enter the fabric being woven without stopping the loom.

It will be apparent that the present invention may be embodied in other specific forms without departing from the spirit or essential attributes thereof, all of which are intended to be encompassed by the appended claims.

What is claimed is:

1. Apparatus for detecting the presence of a weft yarn pick properly inserted in a path from a first position adjacent one edge of a fabric being woven on a loom with said pick being inserted through the shed of said loom and projected beyond the opposing edge of said fabric comprising, first sensing means located in the shed intermediate said one edge and said opposing edge of said fabric, and a second sensing means located outboard of said opposing edge of said fabric to detect the end of the pick projected beyond the edge of the fabric, and fault detection means responsive to said first and second sensing means being operative to sense the presence of different types of weft yarn defect along said path.

2. Apparatus as set forth in claim 1 wherein said first sensing means and second sensing means are connected by the fault detection means to stop means for said loom, and logic means controlling said stop means such that a single no yarn present signal from said first sensing means is operative to actuate said stop means to halt operation of said loom, and a single no yarn present signal from said second sensing means is not operative to actuate said stop means.

3. Apparatus for detecting the presence of a weft yarn pick properly inserted in a path from a first position adjacent one edge of a fabric being woven on a loom with said pick being inserted through the shed of said loom and projected beyond the opposing edge of said fabric comprising, first sensing means located intermediate said one edge and said opposing edge of said fabric, a second sensing means located outboard of said opposing edge of said fabric, fault detection means responsive to said first and second sensing means being operative to sense the presence of said weft yarn in said path connecting said first sensing means and second sensing means to stop means for said loom, and logic means controlling said stop means such that a single no yarn present signal from said first sensing means is operative to actuate said stop means to halt operation of said loom and a single no yarn present signal from said second sensing means is not operative to actuate said stop means, and means responsive to a predetermined number of no yarn present signals at said second sensing means is operative to actuate said stop means.

4. A method of detecting a weft yarn pick properly inserted in a path from a first position adjacent one edge of a fabric being woven on a loom with said pick being inserted through the shed of said loom and projected into the selvage beyond the opposing edge of the fabric comprising the steps of, sensing the presence of said weft yarn along the fabric within the shed in said path intermediate said one edge and said opposing edge of said fabric, sensing the presence of weft yarn in said path outboard of said opposing edge of said fabric, and processing the sensed signals to determine different types of weft yarn defects.

5. The method as set forth in claim 4 including the steps of, stopping the operation of said loom when a single condition of no yarn present is sensed in the weft yarn path intermediate said one edge and said opposing edge of said fabric, and permitting said loom to continue operation when a single condition of no yarn present is sensed in the weft yarn path outboard of said opposing edge of said fabric.

6. A method of detecting a weft yarn pick properly inserted in a path from a first position adjacent one edge of a fabric being woven on a loom with said pick being inserted through the shed of said loom and projected beyond the opposing edge of the fabric comprising the steps of, sensing the presence of said weft yarn in said path intermediate said one edge and said opposing edge of said fabric, sensing the presence of weft yarn in said path outboard of said opposing edge of said fabric, stopping the operation of said loom when a single condition of no yarn present is sensed in the weft yarn path intermediate said one edge and said opposing edge of said fabric, permitting said loom to continue operation when a single condition of no yarn present is sensed in the weft yarn path outboard of said opposing edge of said fabric and stopping the operation of said loom when a predetermined count of conditions of no yarn present are sensed in the weft yarn path outboard of the opposing edge of said fabric.

7. Apparatus for detecting weft yarn to effect controls in a high speed loom comprising, a plurality of optic fibers positioned with fiber ends thereof terminating in a two dimensional sensing face for observing the weft yarn over a span width of a plurality of fibers in a pathway moving transversely across a sensing position thereby to provide a signal of a duration sustained over the time it takes the yarn to travel across said face, means sending light energy into selected uniformly distributed across said face transmission fibers of said plurality of optic fibers to be directed toward the weft yarn as it moves across said sensing position, and means for detecting said light energy reflected from the yarn comprising other selected uniformly distributed across said face reception fibers of said plurality of optic fibers whereby a substantially uniform signal is detected over said span thereby to provide a good signal to noise ratio, a long duration signal and to eliminate false signal problems due to yarn flutter.

8. Apparatus as set forth in claim 7 wherein said optic fibers are of a diameter of the order of that of the weft yarn at said sensing face to produce a span of a plurality of yarn widths.

9. Apparatus as set forth in claim 8 wherein said fibers have a diameter of the order of 0.001 inch (0.25 inch) and present a sensing face at the sensing position having a diameter in the order of 0.040 inch (10 mm).

10. Apparatus as set forth in claim 7 wherein said transmission fibers and reception fibers are located in a confusor element of said loom and positioned intermediate opposing edges of fabric being woven on said loom.

11. Apparatus as set forth in claim 10 including means for inserting picks of weft yarn sequentially across the loom, and means operating said loom in different modes responsive to said signal signifying the presence or absence of a pick at a prescribed pick cycle time.

12. Apparatus for detecting the presence of a weft yarn leaving an air containment guide in a high speed shuttleless loom after said weft yarn has been moved across said loom, comprising in combination, a confuser element providing a passageway for said weft yarn as said weft yarn moves across said loom, said confuser element having a gap therein through which the weft yarn exits said passageway for entry into a shed of warp yarns on said loom, a fiber optic bundle including a plurality of optical fibers carried by said confusor element and terminating at a common locus to provide a sensing face the width of a plurality of yarn widths adjacent said gap on a single side thereof, said weft yarn moving past said sensing face to intercept a plurality of said fibers as the yarn exits said passageway thereby to provide a signal of long duration, said fiber optic bundle being separated into first and second set of fibers, said first set being connected with a light source and the fibers of said first set being uniformly dispersed at said sensing face, and said second set of fibers being uniformly interdispersed with said first set of fibers at said sensing face, and a light absorbing face opposing the set of fibers whereby light transmitted through said first set from said light source will be received by said second set when said light is reflected off a weft yarn moving through said passageway and past said sensing face thereby providing a high signal to noise ratio.

* * * * *